US009220379B2

(12) United States Patent
Winestock et al.

(10) Patent No.: US 9,220,379 B2
(45) Date of Patent: Dec. 29, 2015

(54) WIPES DISPENSER

(71) Applicant: Clear Global, LLC, Wilmette, IL (US)

(72) Inventors: Nancy Winestock, Wilmette, IL (US); David Pankey, Boca Raton, FL (US); Jerry Zinnbauer, Cornelius, NC (US)

(73) Assignee: CLEAR GLOBAL, LLC, Wilmette, IL (US)

( * ) Notice: Subject to any disclaimer, the term of this patent is extended or adjusted under 35 U.S.C. 154(b) by 156 days.

(21) Appl. No.: 14/160,965

(22) Filed: Jan. 22, 2014

(65) Prior Publication Data

US 2014/0291439 A1 Oct. 2, 2014

Related U.S. Application Data

(60) Provisional application No. 61/805,343, filed on Mar. 26, 2013.

(51) Int. Cl.

| | |
|---|---|
| ***A47K 10/38*** | (2006.01) |
| ***B65D 83/08*** | (2006.01) |
| *A47K 10/32* | (2006.01) |

(52) U.S. Cl.

CPC ..... *A47K 10/3827* (2013.01); *A47K 10/38* (2013.01); *B65D 83/0805* (2013.01); *A47K 2010/326* (2013.01); *A47K 2010/3233* (2013.01); *A47K 2010/3253* (2013.01); *A47K 2010/3266* (2013.01)

(58) Field of Classification Search

CPC ..... A47K 2010/3266; A47K 10/3827; A47K 10/38; B65D 83/0805

See application file for complete search history.

(56) References Cited

U.S. PATENT DOCUMENTS

| | | | | |
|---|---|---|---|---|
| 6,056,235 | A * | 5/2000 | Brozinsky | 242/598.6 |
| 2009/0194554 | A1* | 8/2009 | Bliss et al. | 221/46 |
| 2013/0075416 | A1* | 3/2013 | Boyce | 221/34 |
| 2014/0175110 | A1* | 6/2014 | Bechyne | 221/45 |

* cited by examiner

*Primary Examiner* — Luis A Gonzalez

(74) *Attorney, Agent, or Firm* — Preti Flaherty Beliveau & Pachios LLP

(57) ABSTRACT

A dispenser for wipes materials and for enabling convenient dispensing of wipes from a roll. At least one side port with a cap is provided to enable the removing of a wipe. An orifice within the port may frictionally engage the wipes. A curved barrier sheet of material between the wipes roll and the dispenser body aids in loading a replacement roll of wipes into the dispenser. The barrier sheet is has an opening for a wipe to pass. The dispenser is refillable through a removable end. Axial spindles suspend the roll for rotation within the dispenser. A spool for use with the dispenser has linearly disposed channels on an outer surface to reduce adhesion with some materials and to improve frictional engagement with others.

21 Claims, 15 Drawing Sheets

FIG. 16
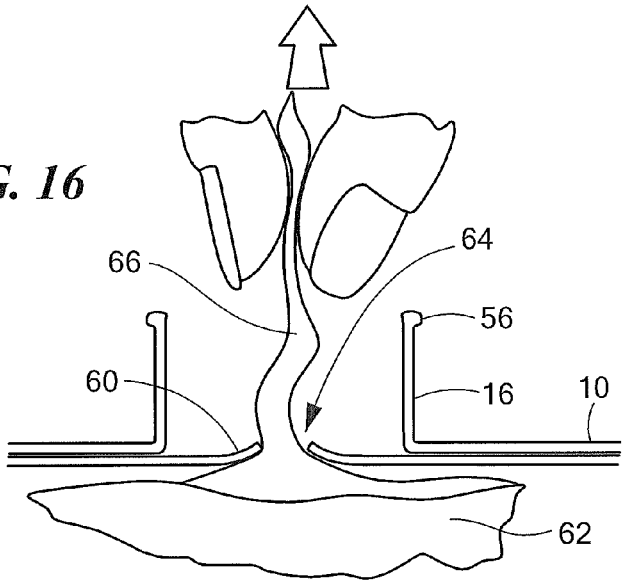
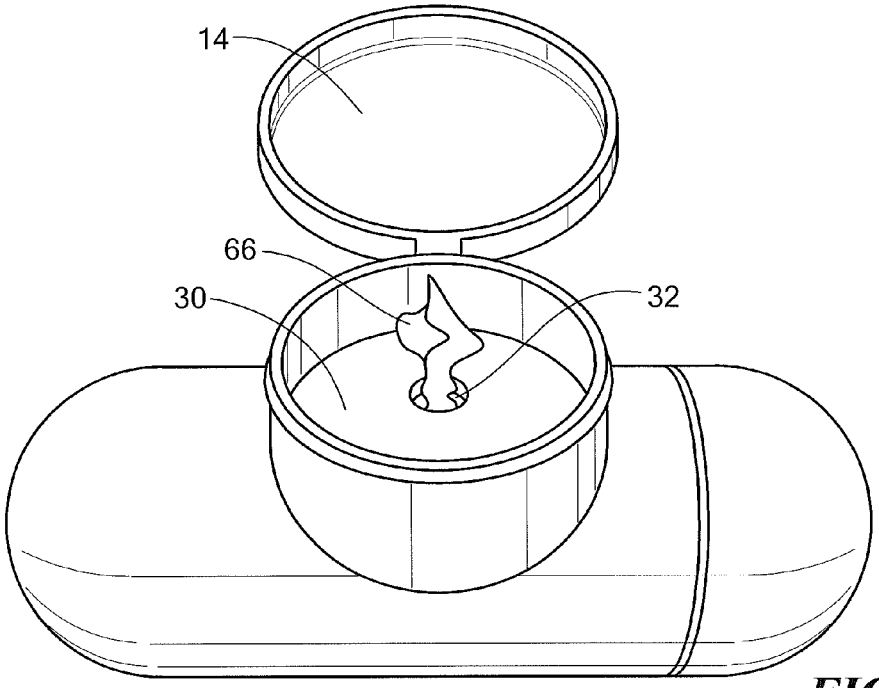
FIG. 15

WIPES DISPENSER

STATEMENT REGARDING FEDERALLY SPONSORED RESEARCH OR DEVELOPMENT

N/A

BACKGROUND OF THE INVENTION

The term "wipes" may refer to a variety of disposable cleaning and/or disinfecting sheets of cloth or cloth-like material. Wipes may be provided dry as with the common facial tissue or pre-moistened as with well-known baby wipes, depending upon the intended use. The type of paper or non-woven media and the liquid used for moistening have gone through many changes over time as improved materials and new applications have been identified.

However, the packaging and delivery systems employed for wipes dispensing has not similarly evolved. For example, the predominant packaging mode employed in the current marketplace is a rectangular box having a top-opening door or a lid enabling access to the uppermost one of an interleaved stack of wipe sheets. Such geometries may be cumbersome and inconvenient for personal use. They may also overly expose moistened wipes to the atmosphere, leading to premature evaporation of the moistening agent and drying of the wipes.

Identifying a suitable, efficient delivery mechanism for pre-moistened wipes configured in a continuous roll of severable, consecutive wipes has been a challenge in the industry, particularly with respect to defining a package that is easily and unobtrusively portable. What is required is a simple to use, efficient, low cost, and refillable delivery mechanism for rolls of wipes, especially for pre-moistened wipes.

Spools for use with rolls of various materials have been employed to enable smooth rotation of the roll within an enclosure. However, prior art spools have typically been cylinders having a continuous contact surface. Materials exhibiting a degree of adhesion do not release well from these spools. This is particularly true for commonly used low-cost spool materials including cardboard or molded plastic. At the same time, non-adhesive materials are prone to slipping about prior art spools, leading to irregular degrees of resistance while unrolling or dispensing the rolled materials. What is needed is a spool design that reduces the effect of adhesion for certain materials while enhancing the gripping effect between materials and the spool for non-adhesive materials. The materials in question may include rolls of wipes or similar goods.

BRIEF SUMMARY OF THE INVENTION

Disclosed is an injection molded dispenser configured to receive either one or two rolls of wipes materials. The edges and contours of the dispenser are rounded, reducing the presence of sharp corners or hard angles consistent with existing dispenser configurations. In a single roll configuration, the dispenser is provided with a side port enabling the removal of an outermost wipe from a point approximately mid-way along its leading edge. In a dual roll configuration, a side port is provided on opposing sides of the dispenser, adjacent a respective roll, similarly located approximately mid-way along the length of the dispenser and the rolls contained therein. The location of these ports substantially reduces the effects of torque on the wipes roll that would occur if the outermost wipe were removed from a point closer to either end of the respective roll.

As employed herein with respect to various types of dispensable tissue materials, the term "roll" may refer to a set of tissues which are consecutively attached and separable, and which are configured in a cylindrical form for subsequent dispensing, or may refer to a set of tissues, including interleaved tissues, which are configured so as to fit within a cylindrically shaped, or semi-cylindrically shaped, dispenser body. In the latter embodiment, a degree of frictional engagement may exist between consecutive tissue sheets, whereby removal or extraction of one sheet results in at least partial removal or extraction of the next consecutive sheet.

The cross-section of the dispenser may have one of a variety of shapes consistent with the requirement that it present no sharp corners or hard angles. Similarly, the ports may be may be sealed by one of a variety of removable caps, the caps being either independent and freely removable or unitary with the dispenser body and captive, such as through the use of a living hinge. For use with pre-moistened wipes, the port is preferably provided with an orifice that minimizes evaporative loss of moisture. In certain embodiments, the port orifice is configured to frictionally engage the next consecutive wipe, whereby as the outermost wipe is extracted from the dispenser the next wipe is retained substantially within the dispenser and the juncture between the wipes is separated. In one embodiment, the frictional engagement feature is integrally disposed into the dispenser body itself.

In an alternative embodiment, the frictional engagement feature is disposed within a curved barrier sheet that is disposed between the wipes roll and the dispenser body itself. Such a barrier sheet may be axially removable from the dispenser and be used to aid in loading a replacement roll of wipes into the dispenser. The barrier sheet may further find utility in retaining moisture, exuded from the wipes roll within the enclosure, thus preventing the moisture from accumulating proximate the enclosure port and leaking out onto a user or their purse, pocket, etc. The barrier sheet is preferably provided with an opening configured to frictionally engage a wipes sheet passing therethrough and to minimize evaporation of moisture within the wipes roll.

Preferably, one end of the dispenser is removable, thereby enabling the refilling of the dispenser with a replacement roll of wipes materials. A distal end of the dispenser is ideally provided with an axial projection configured to receive a spool upon which the wipes materials are wound. The removed end is also provided with a similar axial projection that is configured to for insertion into the spool upon reattachment of the end onto or into the dispenser body. Once so reattached, the roll is configured for smooth and free rotation on the spool and about the respective axis.

Also disclosed is an improved spool configuration for use with a roll of wipes material. The spool may be used with the presently disclosed wipes dispenser or may be adapted for use in other environments. The spool is provided with a plurality of linearly disposed channels on an outer, material-contacting surface thereof. The channels are preferably evenly spaced about the periphery of the spool.

Moist wipes may impart a greater degree of adhesion onto the spool when wound thereabout. By providing a plurality of such channels, the surface area between the spool and the terminal wipe or wipes is reduced. Thus, when the last wipe or wipes are extracted from the spool, less adhesion must be overcome, thereby reducing the strain imparted on the axial spindle projections supporting the spool.

In contrast, a roll of dry wipes may exhibit little or no adhesion to the spool. In this case, the channels form irregularities that frictionally engage the overlying wipes material, thereby preventing or reducing the degree of slippage between the wipes and the spool and ensuring constant resistance to wipes withdrawal is experienced by a user. The arcuate width of the channel is selected to enable this frictional engagement but is limited so as to not present a sharp edge that might cut or crease the wipes materials wound thereon.

In one embodiment, the channels are formed as perforations in the spool, forming an opening between the interior and exterior thereof. However, in an alternative embodiment, the channels are linear recesses formed in the spool. The latter is particularly desirable for use with pre-moistened wipes as it prevents the flow of moisture to the spool interior including through evaporation.

BRIEF DESCRIPTION OF THE SEVERAL VIEWS OF THE DRAWINGS

Embodiments of the present invention may be better understood by referring to the following description in conjunction with the accompanying drawings in which:

FIG. 15 is a perspective view of a portion of a wipes sheet projecting from an opening within a port of the wipes dispenser of FIG. 1;

FIG. 16 illustrates the removal of a wipes sheet by a user through the opening of FIG. 15;

DETAILED DESCRIPTION OF THE INVENTION

Disclosed is a novel dispenser for enabling dry or pre-moistened wipes, tissues, and other sheet-like materials, provided in rolled form, to be dispensed. Such a dispenser is referred to herein simply as a wipes dispenser though it is not necessary limited to dispensing wipes. A rigid or semi-rigid container is preferably provided with rounded surfaces to avoid sharp edges and corners. The container in one embodiment is provided as injected molded polypropylene or polyethylene.

Figure 1:
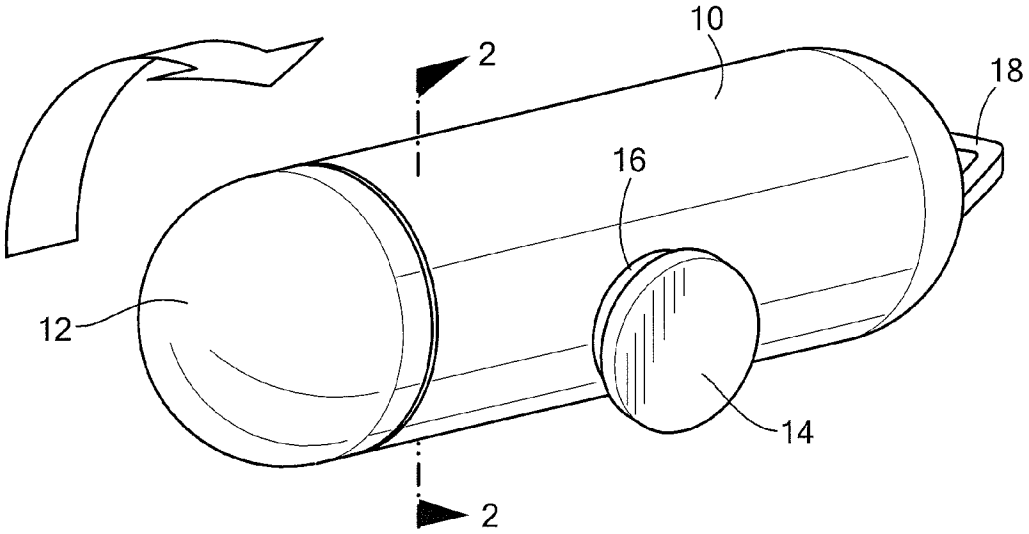
FIG. 1 is a perspective view of a first embodiment of a wipes dispenser according to the present patent application.

A first embodiment of such a wipes dispenser 10 is illustrated in FIG. 1. The dispenser 10 is generally cylindrical with rounded ends. One such end is referred to as a fill cap 12 that is removable, thus providing access to the dispenser interior cavity so that a wipe roll or module may be inserted therein. An access cap 14 enables easy access to a next-to-be removed wipe or tissue. Preferably, both caps are capable of providing a moisture-tight seal, particularly in the case when pre-moistened wipes are to be dispensed.

The access cap 14 is disposed in cooperation with a side port 16. The side port is preferably disposed mid-way along the length of the dispenser body 10. When a wipe is removed from this centrally located port, torque is evenly distributed along the length of the roll; if the port were located at one end of the dispenser, torsional sheer stress could interfere with the even withdrawal of successive wipes and would stress the spindles upon which the spool is disposed.

In the dispenser embodiment illustrated in FIG. 1, a loop 18 is provided at one end of the body 10, such as for attaching the dispenser to a spring-loaded D clip. The loop is not a required part of the disclosed dispenser, however.

Figure 2:
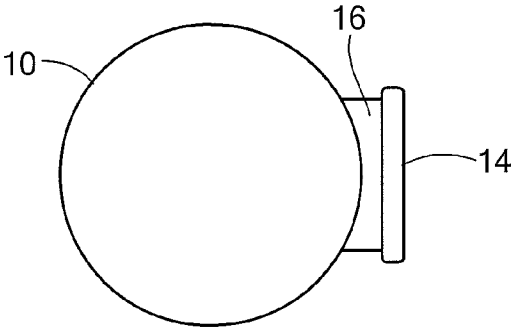
FIG. 2 is a cross-sectional view of the wipes dispenser of FIG. 1.

The embodiment of FIG. 1 is substantially circular in cross-section, as is evident from the cross-sectional view of FIG. 2, taken along lines 2-2 in FIG. 1. The fill cap 12 in a first embodiment is removably attachable through mutually aligned threads (not shown in FIG. 1) on the cap and body 10. Such rotation is suggested by the arrow in FIG. 1.

Figure 3:
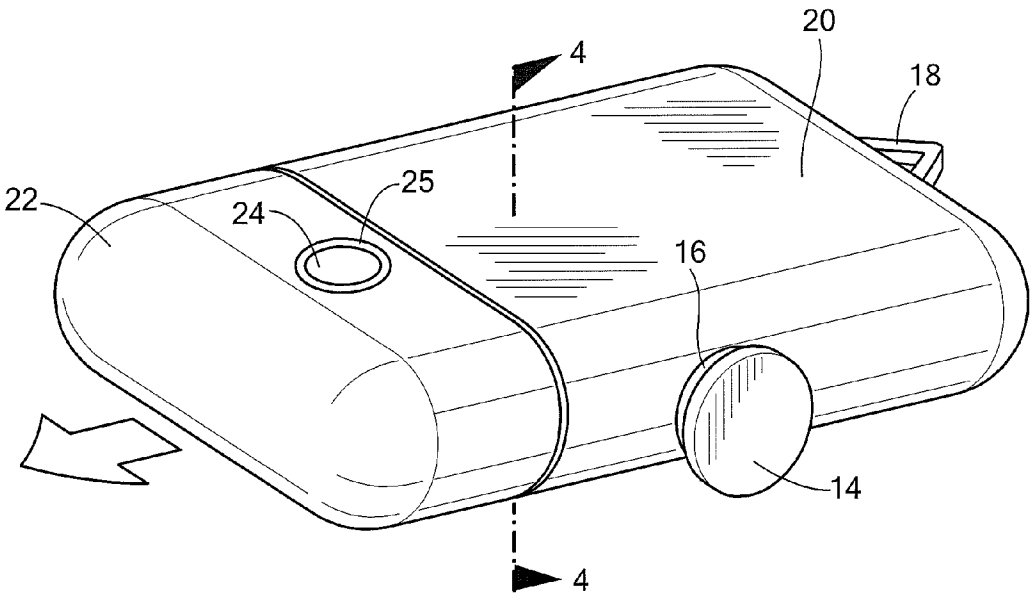
FIG. 3 is a perspective view of a second embodiment of a wipes dispenser according to the present patent application.
Figure 4:
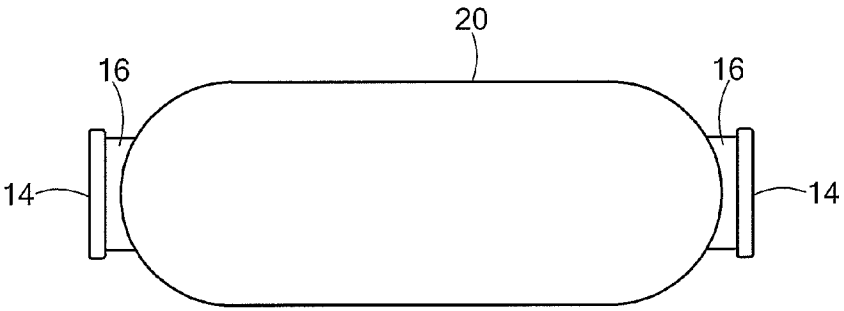
FIG. 4 is a cross-sectional view of the wipes dispenser of FIG. 3.

The dispenser embodiment illustrated in FIGS. 3 and 4 is ideally suited for retaining two wipes rolls or modules in a side-by-side arrangement, as will be detailed below. This embodiment may be referred to as a dual dispenser. Access to the wipes contained therein is provided via a similar cap 14 and port 16 arrangement as depicted in FIGS. 1 and 2, though in this embodiment, two such cap and port arrangements are provided, one on each side of the dispenser 20.

Since this dispenser embodiment has a non-circular cross-section, as is evident from the cross-sectional view of FIG. 4, taken along lines 4-4 in FIG. 3, the fill cap 22 is configured for sliding engagement with the body 20, as suggested by the arrow in FIG. 3. A friction lock 24 is provided to selectively release the fill cap 22. A more detailed discussion of the friction lock will follow.

The embodiment depicted in FIG. 3 includes a loop 18 which is an optional component.

In all of the foregoing embodiments, for both the single and dual dispensers, the body and the fill cap, when joined, have no surface feature or surface transition that is ninety degrees or less, thereby presenting a rounded, comfortable to hold and carry body shape.

Figure 5A:
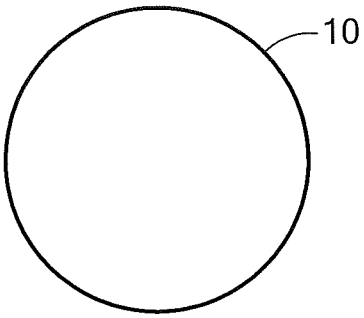
FIGS. 5A and 5B are each cross-sectional embodiments of the wipes dispenser of FIG. 1.
Figure 5B:
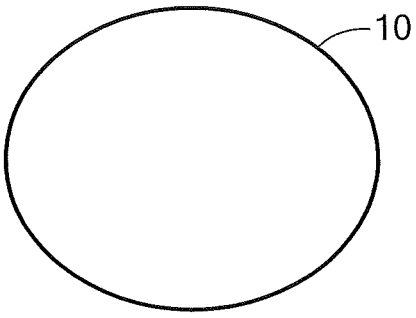

FIGS. 5A and 5B illustrate alternative cross-sections of the single roll dispenser embodiment generally depicted in FIG. 1. The embodiment of FIG. 5A is circular, as is also shown in FIG. 2. The embodiment of FIG. 5B is ovoid. Note that if the single roll wipes dispenser of FIG. 1 were to have the ovoid cross-section depicted in FIG. 5B, the fill cap 12 would obviously not be threaded but instead would mate with the dispenser body 10 through other frictional means, to be discussed below.

Figure 5C:
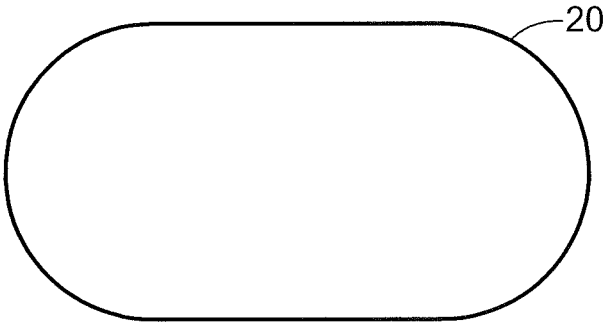
FIGS. 5C and 5D are each cross-sectional embodiments of the wipes dispenser of FIG. 3.
Figure 5D:
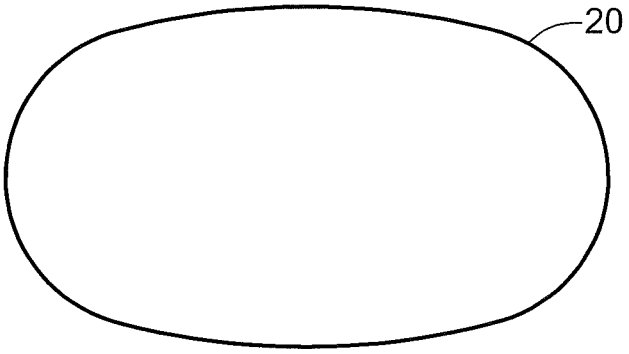

FIGS. 5C and 5D illustrate alternative cross-sections of the two roll wipes dispenser embodiment generally depicted in FIG. 3. The embodiment of FIG. 5C is oblong, whereas the embodiment of FIG. 5D is ovoid.

Figure 6A:
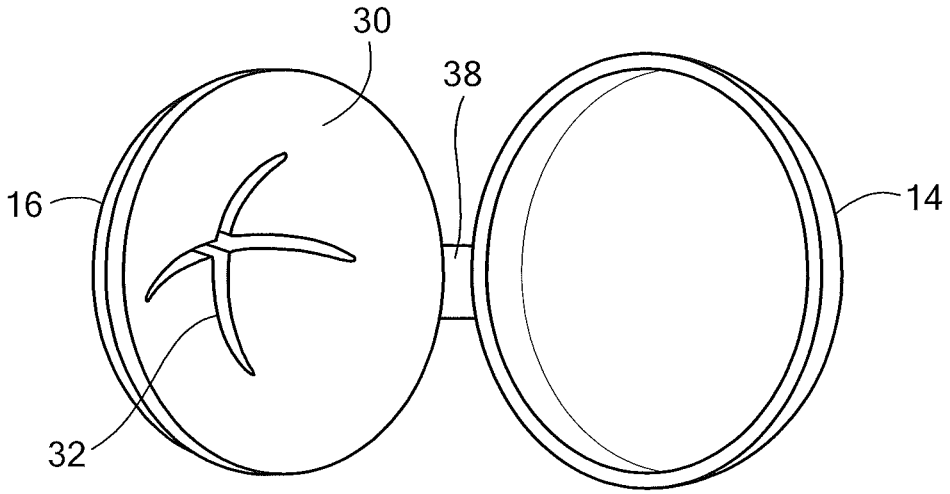
FIG. 6A is a perspective view of a first embodiment of a port and cooperating cap of the wipes dispenser of FIG. 1 or 3.
Figure 6B:
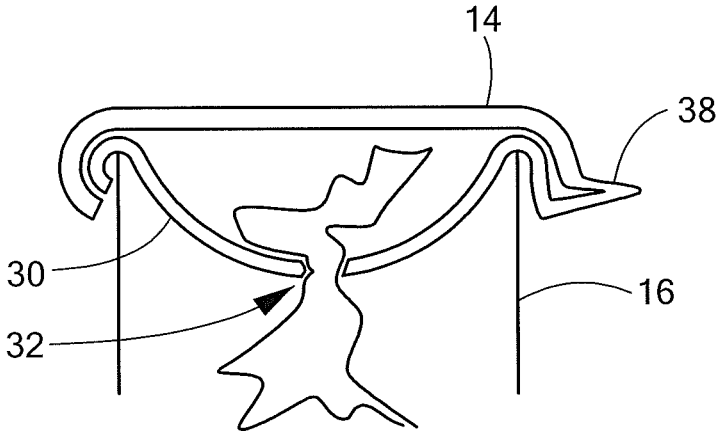
FIG. 6B is a cross-sectional view of the port and cap of FIG. 6A with the cap in the closed position.

FIG. 6A depicts a first embodiment of the access cap 14 and side port 16. In the illustrated embodiment, the port is provided with a pliant membrane 30 that may be concave (as shown), flat, or convex. The membrane is provided with a discontinuity 32 that enables selective user access to an outermost wipe. For example, the discontinuity may be X-shaped (as shown) as defined by the gaps between a plurality of radially disposed pliant fingers. A user may grasp an outermost wipe by inserting part of one or more fingers into the discontinuity and pulling out part of the outermost wipe on a roll. Preferably, the pliant membrane 30 is sufficiently rigid to impart frictional force on a wipe as it is manually extracted from the dispenser 10 such that it engages and retains the next, consecutive wipe and a perforated juncture between the wipes is severed, leaving a leading portion of the next, consecutive wipe protruding from the discontinuity, as shown in FIG. 6B. With the cap 14 closed over the side port 16 via friction fit, a substantially moisture-tight seal is created. The cap is preferably though not necessarily attached to the port 16 via a living hinge 38.

Figure 7A:
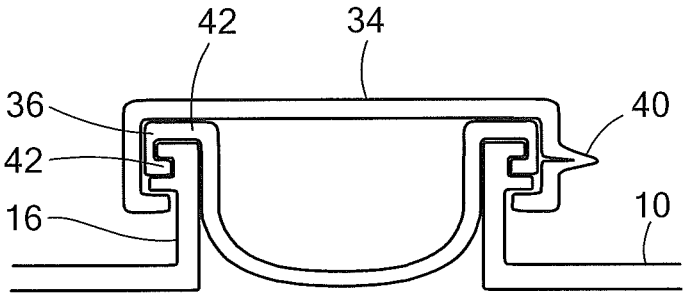
FIG. 7A is a cross-sectional view of a second embodiment of a port and cooperating cap of the wipes dispenser of FIG. 1 or 3.
Figure 7B:
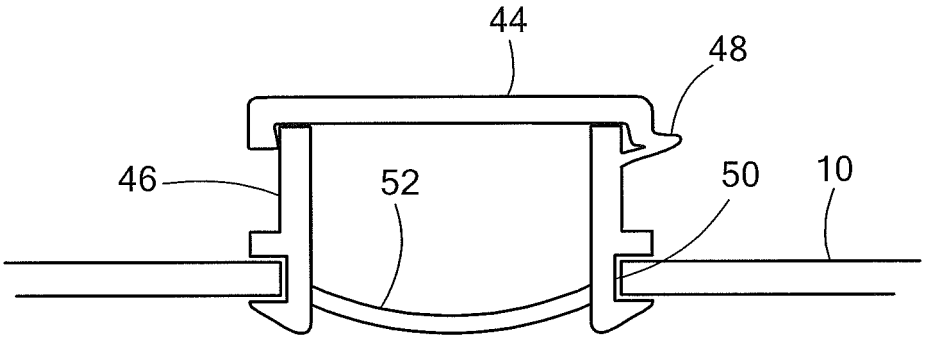
FIG. 7B is a cross-sectional view of a third embodiment of a port and cooperating cap of the wipes dispenser of FIG. 1 or 3.
Figure 7C:
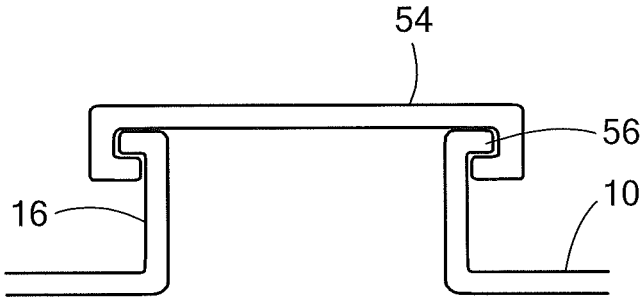
FIG. 7C is a cross-sectional view of a fourth embodiment of a port and cooperating cap of the wipes dispenser of FIG. 1 or 3.

FIGS. 7A through 7C illustrate alternative embodiments of caps and side ports adapted to receive them in the body 10. Note that these embodiments can also be used in conjunction with the body 20 adapted for holding two rolls. In FIG. 7A, a cap 34 is retained on the port 16 via a living hinge 40 and mates with the port 16 via friction fit. The pliant membrane 36 in this embodiment is provided with an outwardly and downwardly extending collar region 42 that is inwardly threaded. The port 16 is provided with complimentary outwardly facing threads for engagement with the threads of the outwardly and downwardly extending collar region. The membrane is thus removable and may be replaced with other membranes, each having a distinct discontinuity (not shown).

The embodiment of FIG. 7B employs a friction fit cap 44 having a living hinge 48, similar to that of FIG. 6A. However, the port 46 is provided as a separable element, not integral with the body 10, that is friction fit into the body via a channel groove 50. The pliant membrane 52 is provided as integral to the port 46. The port and membrane may be removed and replaced with another set having a different discontinuity.

In the embodiment of FIG. 7C, the cap 54 is independent of the port 16 and is configured to snap onto a radial projection 56 of the port.

It will be recognized that a wide variety of combinations of ports, caps, and membranes is available, depending upon the specific application and design requirements such as cost and moisture-retention.

Figure 8:
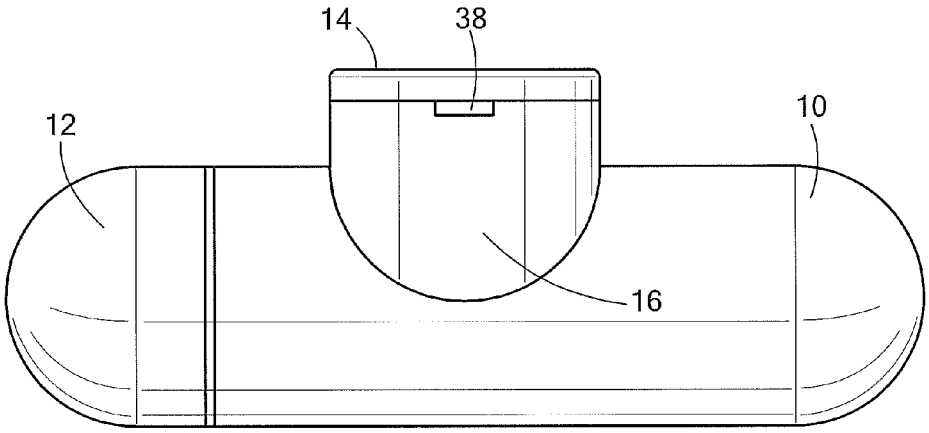
FIG. 8 is an elevation view of the wipes dispenser of FIG. 1.

FIG. 8 is an elevation view of the wipes dispenser of FIG. 1 with the fill cap 12 in place. As shown in FIG. 1 by the large arrow, the fill cap is removed in a first embodiment by unscrewing it, the fill cap and the adjoining surface of the dispenser body 10 having complimentary threads 61. In alternative embodiments, the fill cap may be friction fit onto the body in a manner similar to that demonstrated in FIGS. 6B, 7B, and 7C, and in these alternative embodiments, may or may not have a living hinge between the fill cap and the body.

Figure 9:
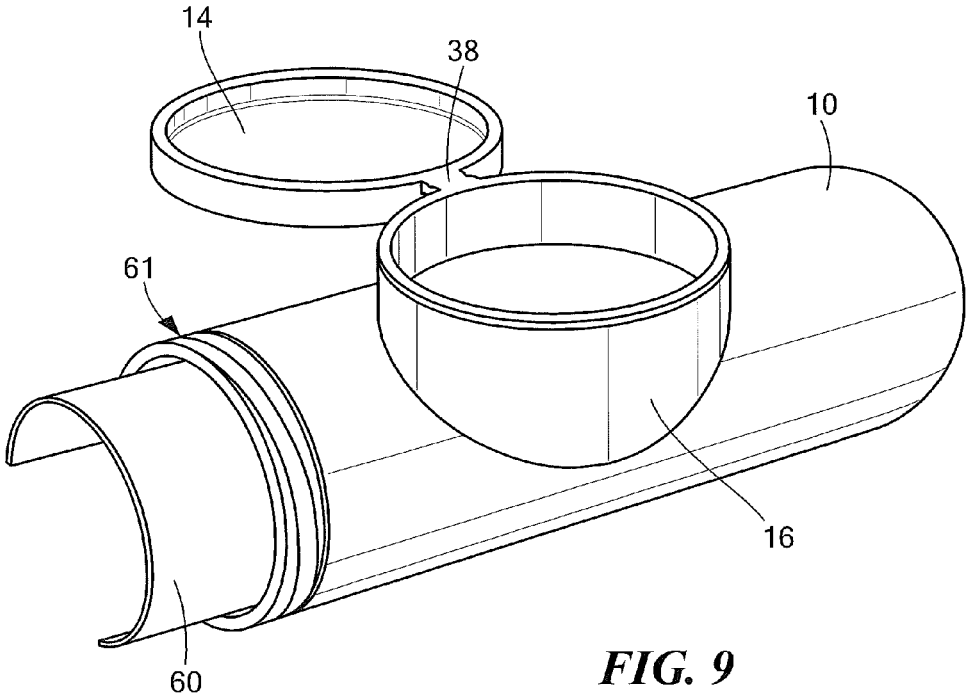
FIG. 9 is a perspective view of a portion of the wipes dispenser of FIG. 1.
Figure 10:
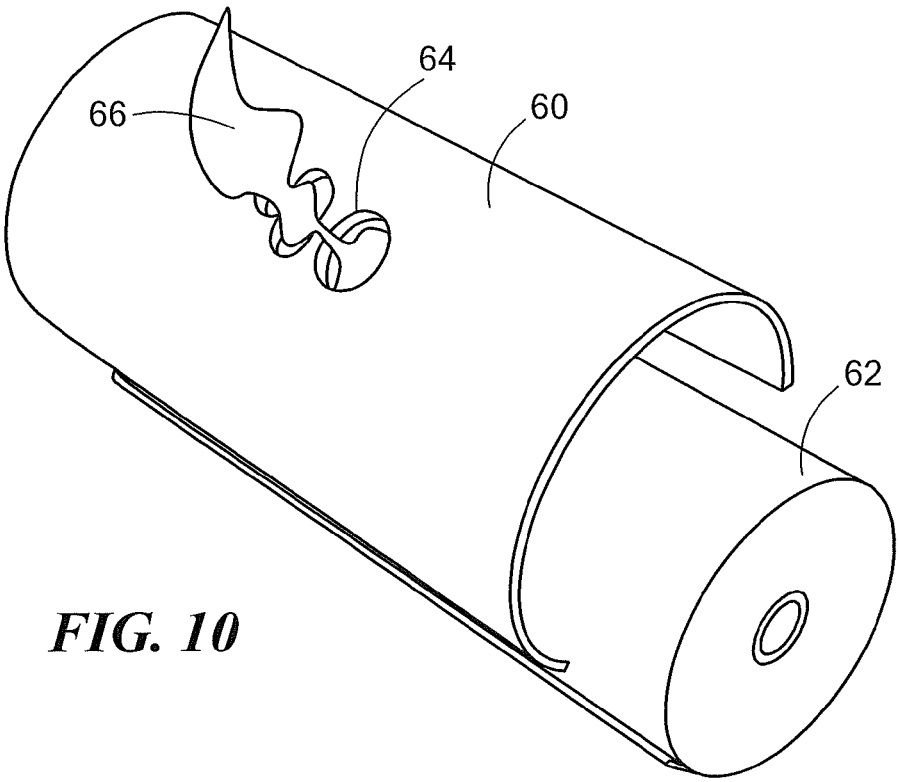
FIG. 10 is a perspective view of a curved barrier sheet which is, along with a replacement roll of wipes, configured for being loaded into the wipes dispenser of FIG. 1.
Figure 14:
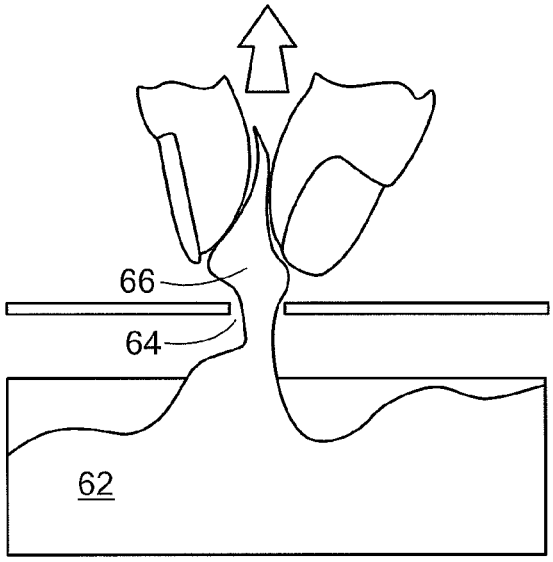
FIG. 14 illustrates the removal of a wipes sheet by a user through an opening in the barrier sheet of FIG. 10.

In FIG. 9, the threaded fill cap has been removed and a curved barrier sheet 60 (also referred to as a retainer sheet) is visible extending from within the body 10. As is seen in FIG. 10, the barrier sheet is configured to receive a wipes roll 62 within it, such that the barrier sheet and wipes roll substantially share a common axis of symmetry. The barrier sheet is provided with an aperture 64 through which a portion of an outermost wipe 66 is manually manipulated, as shown in FIG. 14. The aperture is preferably dimensioned to allow a single wipes sheet to be drawn therethrough. The aperture may be provided as a circular opening, as shown, whereby wipes are freely extractable. Once one or more desired wipes are removed, the user would grasp the next consecutive wipe and sever the junction connecting it to the last desired wipe. Alternatively, the opening may be configured such that wipes meet with frictional resistance as they are extracted, such that the perforated junction between consecutive sheets is severed upon sheet extraction. For example, the aperture 64 may be defined by the gaps between a plurality of radially disposed pliant fingers, such as shown in the membrane 30 of FIG. 6A. If so provided, the membrane would not need to have the restricted discontinuity 32 such as shown in FIG. 6A and instead could be provided with a circular or other shaped opening, such as shown in FIG. 15. Further still, the membrane could be omitted altogether, as in FIG. 7C and FIG. 16.

Figure 11:
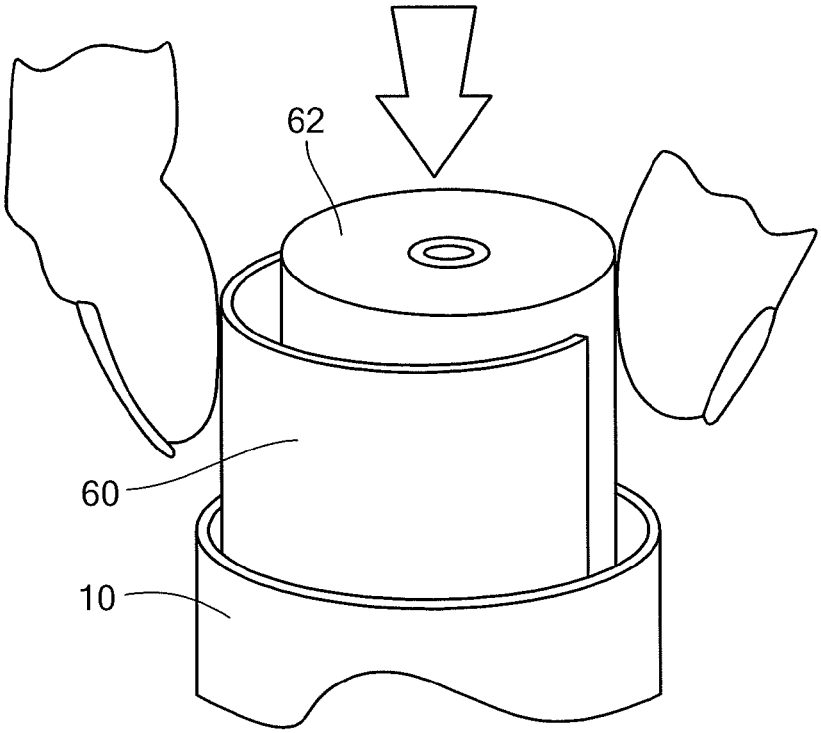
FIG. 11 illustrates the barrier sheet and replacement roll of FIG. 10 being inserted into the wipes dispenser of FIG. 1.

As shown in FIG. 11, a wipes roll 62 is axially inserted into the barrier sheet 60, which is disposed within the body 10. Preferably, the barrier sheet is retained within the body such that it does not rotate with a wipes roll contained therein as one or more wipes are extracted. This is accomplished by disposing the barrier sheet within complimentary linear channels 68 formed on the interior surface of the body, as shown in in FIGS. 12 and 13. Such channels are preferably dimensioned to enable the barrier sheet to be freely moved into and out of the body by means of fingers of the user.

Figure 12:
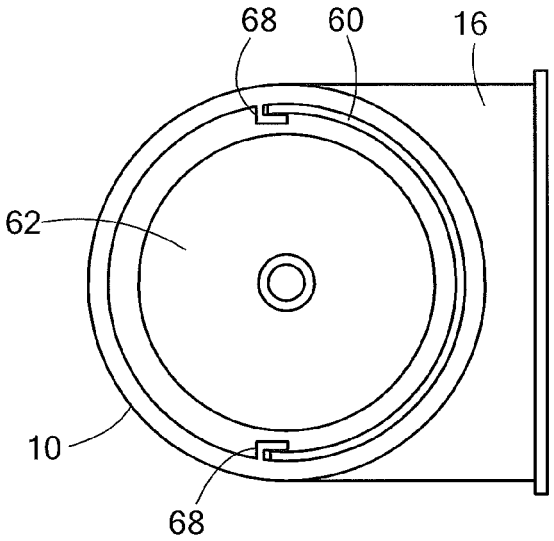
FIG. 12 is a cross-sectional view of the wipes dispenser of FIG. 1 illustrating the relative positioning of the barrier sheet and replacement roll of FIGS. 10 and 11.
Figure 13:
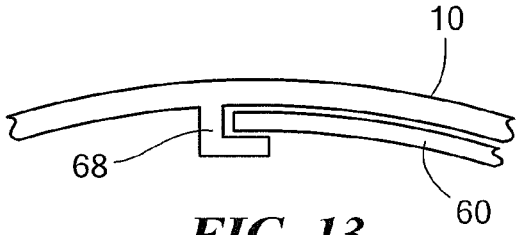
FIG. 13 is a detailed view of a guide rail within the wipes dispenser of FIG. 1 and the barrier sheet of FIG. 10 engaged thereby.
Figure 17:
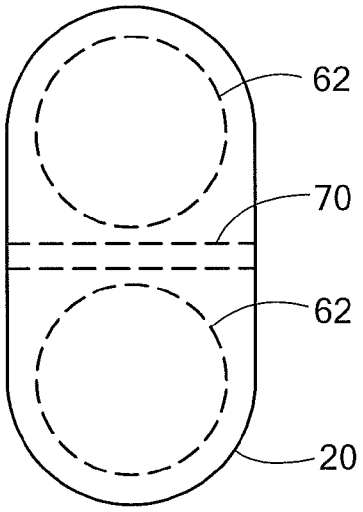
FIG. 17 is a cross-sectional schematic view of the wipes dispenser of FIG. 3 illustrating placement of wipes rolls therein.

While a single wipes roll 62 is depicted in the wipes dispenser 10 of FIG. 12, two side-by-side rolls are schematically illustrated in the dual roll dispenser 20 of FIG. 17. Also visible in schematic form in FIG. 17 is an optional dividing wall 70 between the rolls. Such a wall may completely separate the respective dispenser portions into which the rolls are disposed. This may be of use for a dual roll dispenser intended to retain rolls having disparate liquids contained therein, or one moist roll and one dry roll. Alternatively, the wall may be discontinuous and may simply serve to keep one roll from turning when a wipe associated with the other roll is being extracted. Further, the wall may facilitate the loading of a new roll and/or the unloading of an empty roll without interfering with the other roll.

Figure 18:
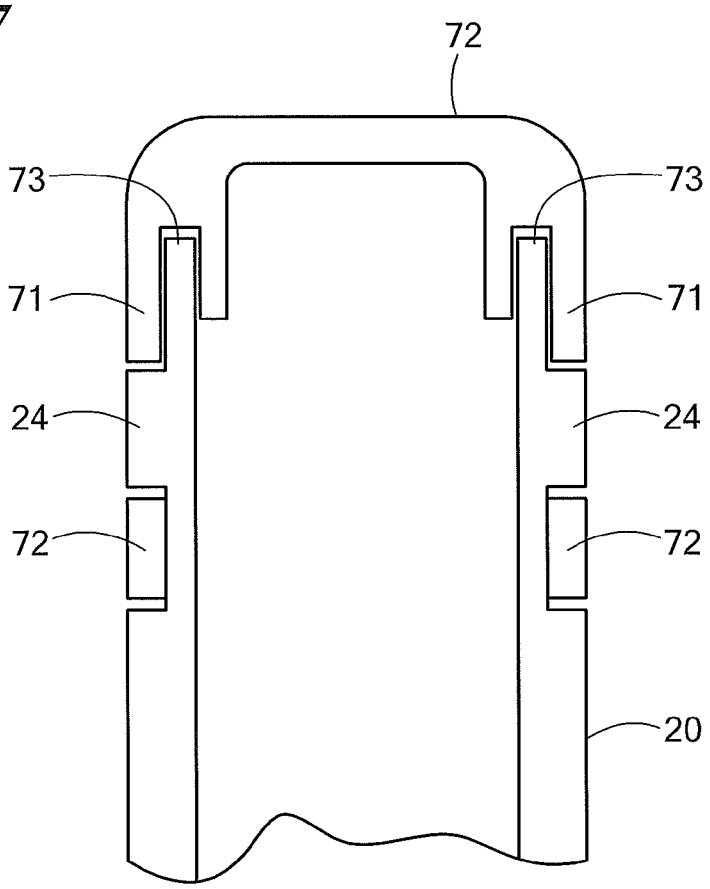
FIG. 18 is a partial cross-sectional view of the wipes dispenser of FIG. 3.

Various fill caps may be employed for the dual dispenser 20. As indicated in FIG. 3, a first embodiment of the fill cap is simply pulled straight off the body 20, as indicated by the large arrow. The cap 22 in this embodiment has portions each with an aperture 25 that extends over and engages a respective friction lock 24 or button. When these buttons, on opposite sides of the dispenser, are manually depressed, towards the interior of the body, they disengage from the complimentarily shaped apertures 25, allowing the cap 22 to be extracted. In FIG. 18, the fill cap 72 for the dual dispenser 20 is shown as having more of a squared off cross-section, though preferably the edges are still rounded to prevent user injury. Friction locks 24 are shown in the cross-sectional view of FIG. 18. Portions 71 of the fill cap 72 extend over complimentary portions 73 of the body 20 to ensure a secure fit and to assist in forming a moisture barrier. One or more resilient sealing surfaces (not illustrated) may be disposed between the cap and the body to further assist in forming a moisture barrier.

Figure 20:
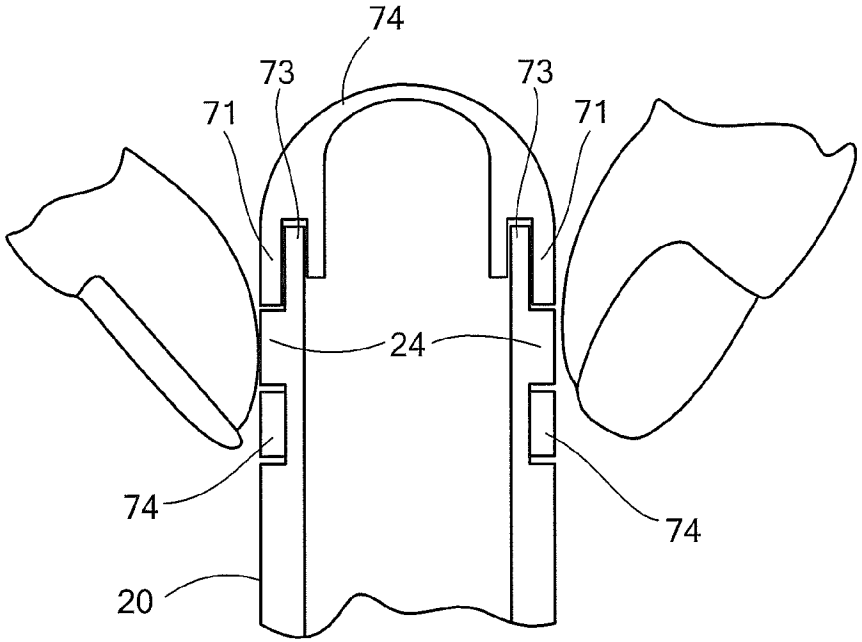
FIG. 20 is a partial cross-sectional view of the wipes dispenser of FIG. 3.

The fill cap 74 embodiment of FIG. 20 is more rounded compared to that of FIG. 18. It is otherwise similar to the embodiment of FIG. 18.

Figure 19A:
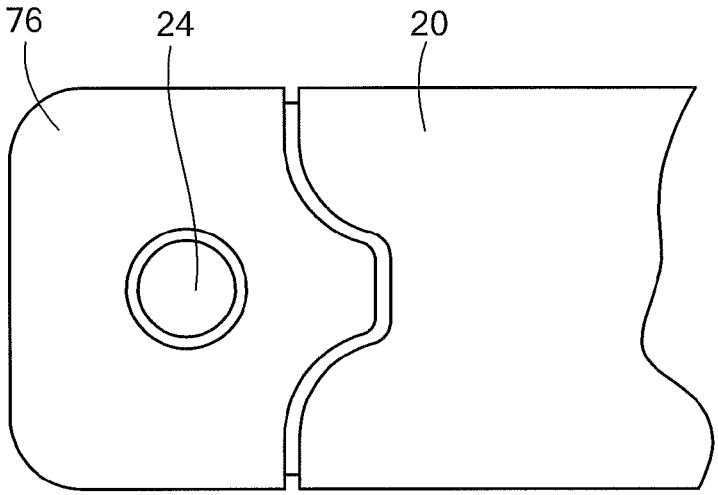
FIGS. 19A and 19B are partial plan views of embodiments of the wipes dispenser of FIG. 3.
Figure 19B:
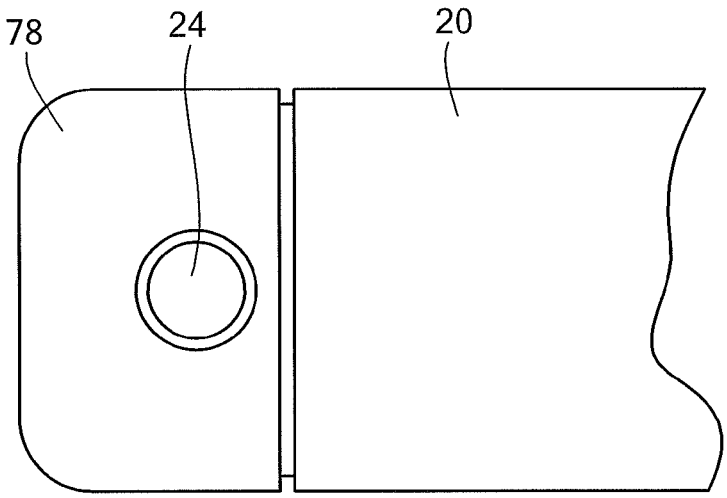

The end caps 76, 78 of FIGS. 19A and 19B illustrate various configurations for the end caps proximate the interface between the caps and the body.

Figure 21:
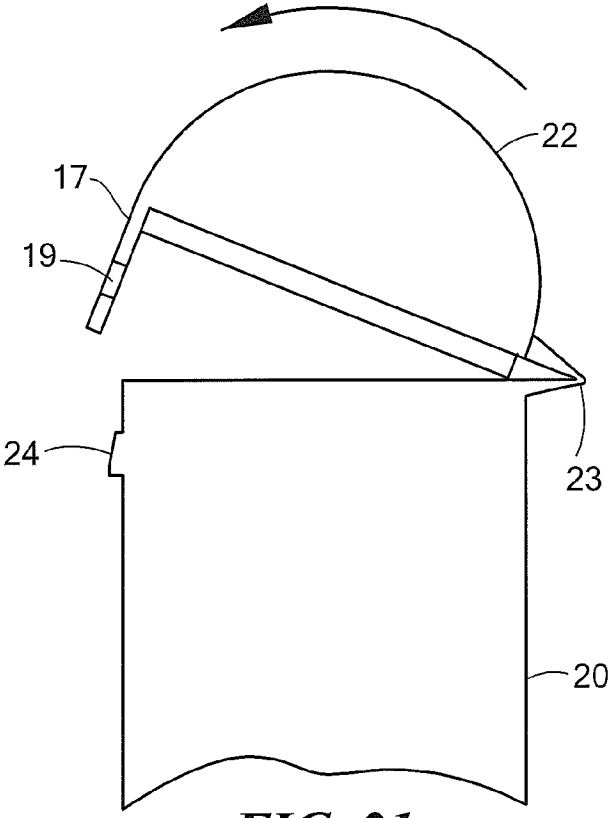
FIG. 21 is a partial elevation view of an embodiment of the wipes dispenser of FIG. 1.

As shown in FIG. 21, the fill cap 22 of FIG. 3 may alternatively be attached to the body 20 via a living hinge 23, such that the cap swings in an arc towards a closed position, as evidenced by the large arrow. A locking portion 17 projecting from the cap 22 is provided with an orifice 19 that interferes with and engages a friction lock 24 on the body 20. To open the cap, the locking portion is lifted outwardly and upwardly to disengage the friction lock.

Figure 22:
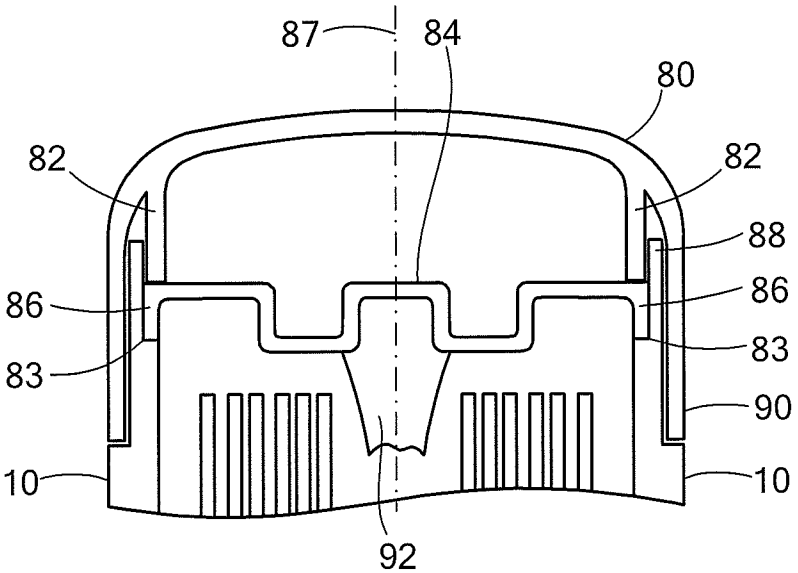
FIG. 22 is a partial cross-sectional view of the wipes dispenser of FIG. 1.
Figure 24:
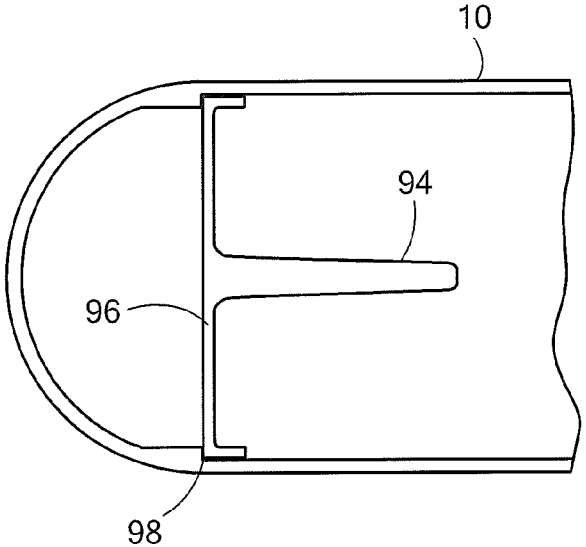
FIG. 24 is a partial cross-sectional view of the wipes dispenser of FIG. 1.
Figure 27:
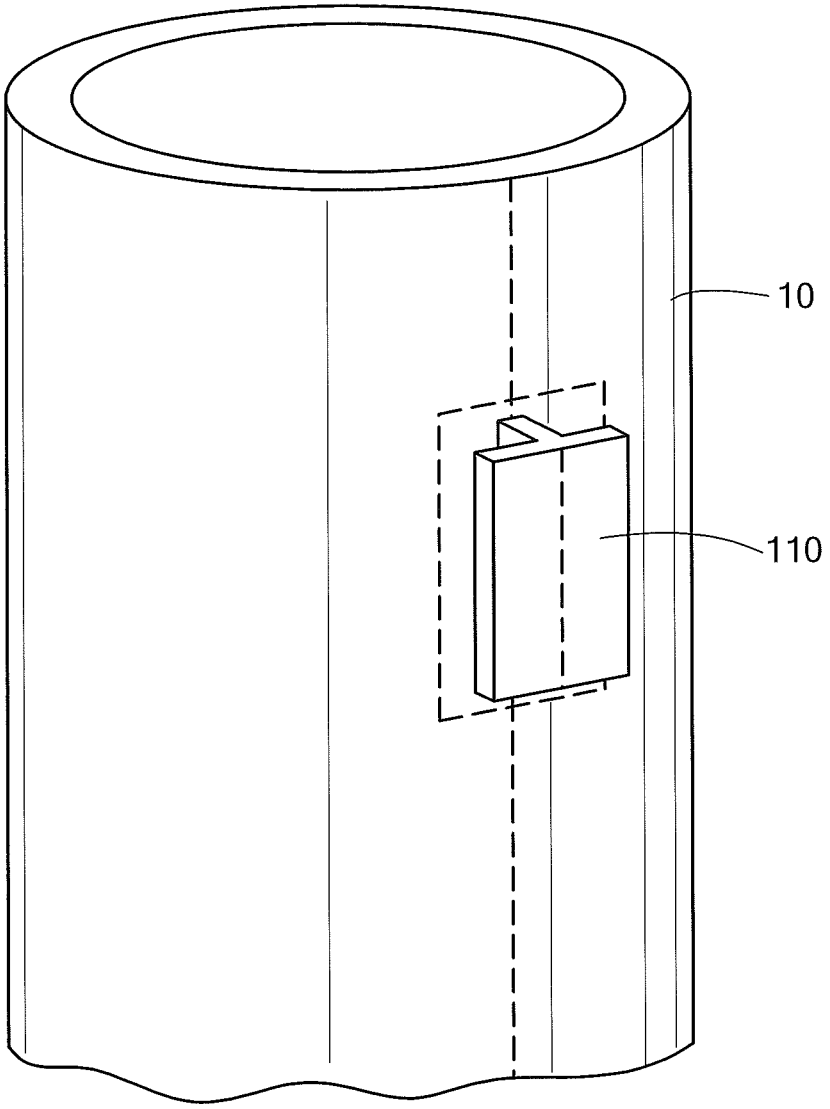
FIG. 27 is a partial perspective view of the wipes dispenser of FIG. 1 illustrating a mounting tab.

The partial view of a single wipes roll dispenser of FIG. 22 includes a variant of a fill cap 80 disposed on the body 10. The cap is provided with a vertical projecting portion 90 that extends over a complimentary upward projection 88 of the body. Between the body 10 and the cap 80 is a sealing wall 84, held in place on a notch 83 of the upward projection 88 of the body 10 by an internal pressure rib 82 acting on a foot 86 of the wall. Extending downwardly (as oriented in the figure) from the sealing wall is one of two complimentary projections or spindles 92, 94 (the other is shown in FIG. 24) each adapted for receiving an end of a wipes roll spool therein. The spindles are preferably disposed coaxial with the axis of symmetry 87 of the body itself, regardless of the body cross-sectional shape.

Figure 23:
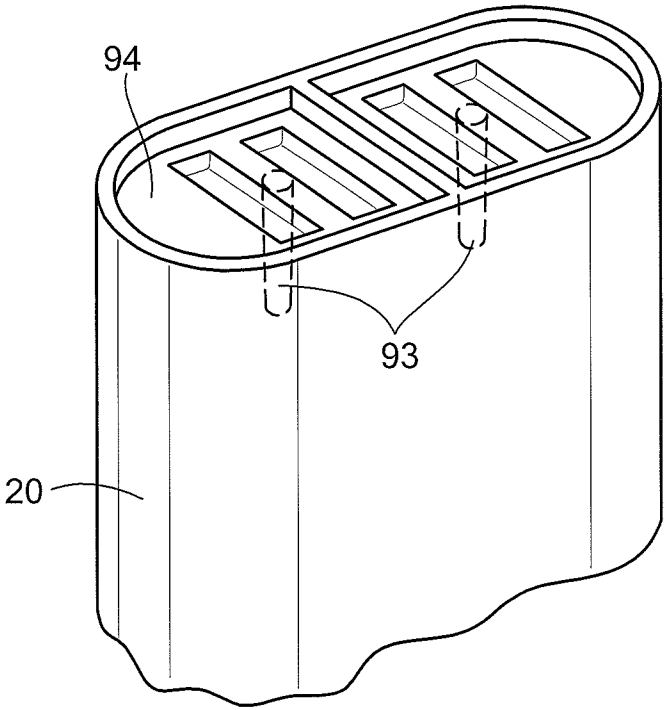
FIG. 23 is a partial perspective view of the wipes dispenser of FIG. 3.

The single roll dispenser sealing wall 84 of FIG. 22 can also be adapted for use as a dual roll sealing wall 94 in the dual dispenser 20, as shown in FIG. 23. Projecting downwardly from this sealing wall 94 are two spindles 93 (shown in phantom) such as the one 92 shown in FIG. 22.

One embodiment of the opposite end of the single roll dispenser 10 of FIG. 22 is seen in FIG. 24. Preferably, a notch 98 is provided on the body 10 interior surface to fixedly receive a plate 96 bearing a complimentary spindle 94 over which a wipes roll spool can be disposed for rotation thereon. Attachment of the plate to the interior of the body may be through gluing, thermal welding, or any known means. The plate may also be formed integrally with the body.

A dual roll dispenser is preferably provided with a plate (not shown) similar to the single dispenser plate 96 in a closed end thereof, this plate having two upwardly projecting spindles akin to the upwardly projecting single spindle 94 of FIG. 24. Thus, in the dual dispenser embodiment, each of two rolls is suspended for rotation about a pair of mutually coaxial spindles.

Figure 25:
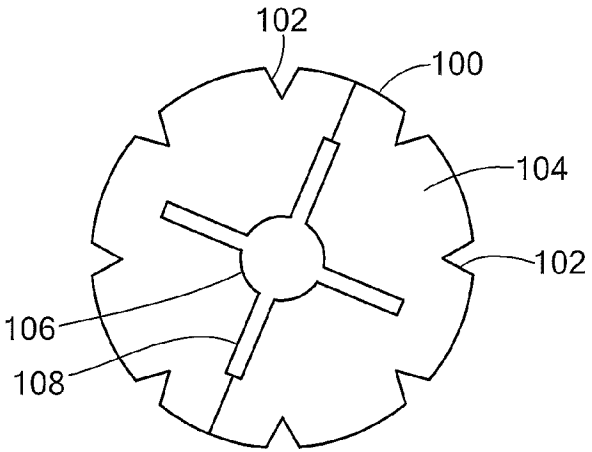
FIG. 25 is an end view of a spool for use in a wipes dispenser of FIG. 1 or 3.
Figure 26:
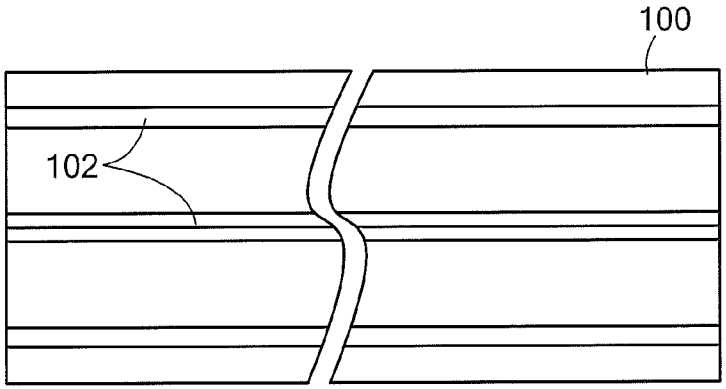
FIG. 26 is a side view of the spool of FIG. 25.

A spool particularly adapted for use with the wipes dispensers of the present disclosure is depicted in FIGS. 25 and 26. This spool is particularly useful for wipes, as disclosed herein, though it can be adapted for a variety of uses. The spool may be formed of extruded plastic, cardboard, metal or any suitable material.

The spool 100 as illustrated is cylindrical in shape, with lateral grooves 102 disposed along its periphery, parallel to an axis of symmetry. In an alternative embodiment, the surface of the spool between grooves may be flat instead of curved, the latter shown in FIG. 25. While a total of eight lateral grooves are illustrated, more or less can be employed, depending upon the requirements of the application. The grooves shown in FIG. 25 are provided as V-shaped recesses is the surface of the spool. In other embodiments, though, the grooves may be discontinuities or rectangular openings in the surface of the spool. The latter embodiment may not be suitable for moisture-bearing wipes since moisture from the roll may seep into the interior of the spool.

The grooves serve several beneficial functions. By reducing the surface area between the spool and the last wipe wound thereon, surface adhesion between the two is reduced. This is of particular benefit when the wipes are moisture-bearing. In the case where the wipes are not moisture-bearing, the grooves may serve the purpose of increasing the frictional interplay between the spool and the last wipe wound thereon. This then mitigates against the tendency for the dry wipes to slip with respect to the spool, thereby requiring an erratic degree of effort to extract wipes from the dispenser.

At either end of the spool 100, a base plate 104 may be provided. An opening 106 is provided in each base plate, the diameter selected to enable the spool to mount and freely rotate on the spindles 92, 93, 94 illustrated in FIGS. 22, 23 and 24. Slots 108 may be provided as a means of preventing a vacuum to be formed within the spool and to reduce the friction between the spindles and spool.

The wipes dispenser of FIG. 1 is particularly well-adapted to being portable. However, particularly in the case where the wipes are to be used for infants or small children, one-handed use of the dispenser may be required. To this end, a further embodiment of the dispenser may be provided with a T-shaped projection 110 that can be received within a slot-shaped bracket (not shown). The bracket may be wall-mounted, such as adjacent a baby changing station, enabling one-handed use of the dispenser.

A description of the process for refilling the single roll dispenser 10 is now provided, though it is understood that a similar procedure is used for a dual dispenser 20.

A user may obtain a refill wipes roll. Rolls of moisture-bearing wipes may be packaged in waterproof secondary packaging, which is opened to extract the refill roll. The fill cap 12 is removed from the body, either by unscrewing it or disengaging it the lid from friction fitting. The barrier sheet 60 is removed or partly extracted and the roll is inserted into it. A free end of the outermost wipe is pulled through the aperture 64 and the barrier sheet is inserted into the L-shaped, parallel channels 68 on the interior surface of the body. The spool 100 is mounted onto the spindle 94 on the bottom of the body, and the sealing wall 84 is disposed on top of the spool, with the upper spindle 92 penetrating the exposed end wall 104 of the spool, then the fill cap is reinstalled. Alternatively, the sealing wall may be fixed within the fill cap and the fill cap with the sealing wall and spindle is inserted into the body and the spool.

In use, the access cap 14 is removed, either by disengaging a frictional fit to the port 16 or by unscrewing it. A user's digits are extended through the discontinuity 32 in the pliant membrane 30, if provided, and a portion of the outermost wipe is removed. If a membrane is not provided, then the user pulls the free end from the curved barrier sheet. The cap is then closed. When a wipe is required, the cap is removed, the wipe is pulled from the port, and the serrations joining consecutive wipes are either separated due to the pulling force and the frictional engagement imparted by the membrane discontinuity or by a user separating the consecutive wipes.

Having thus described several features of at least one embodiment of the present invention, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A dispenser for sheet material consecutively disposed to form a roll, the dispenser comprising:

a body having a first closed end and a second open end, the body defining an interior;

a fill cap for selective engagement with the body second open end;

a side port defining an opening into the body interior;

an access cap configured for selective engagement with the side port;

a curved barrier sheet selectively disposed within the body interior and defining a barrier sheet interior; and an aperture within the barrier sheet for receiving therethrough a sheet to be dispensed, wherein, when the fill cap is disposed on the body second open end, a body mid-point is defined between the fill cap and the body first closed end, wherein the side port is disposed substantially at the mid-point, and wherein, when the barrier sheet is disposed within the body interior, the aperture is substantially aligned with the side port.

2. The dispenser of claim 1, wherein the barrier sheet is configured to selectively receive a roll of sheets material within the barrier sheet interior.

3. The dispenser of claim 1, wherein the barrier sheet aperture is defined by gaps between plural pliant, radially extending fingers.

4. The dispenser of claim 1, wherein the barrier sheet aperture is substantially circular.

5. The dispenser of claim 1, wherein the body further comprises two parallel channels disposed along the length of an interior body wall for selectively receiving the barrier sheet.

6. The dispenser of claim 1, wherein the body second open end and the fill cap are complimentarily threaded.

7. The dispenser of claim 1, wherein the side port comprises a membrane therein, the membrane having an aperture therein for receiving therethrough a sheet to be dispensed.

8. The dispenser of claim 7, wherein the membrane aperture is defined by gaps between plural pliant, radially extending fingers.

9. The dispenser of claim 1, wherein the access cap is integral with and connected to the port via a living hinge.

10. The dispenser of claim 1, wherein the access cap engages with the side port via one of friction fit or screw threads.

11. The dispenser of claim 1, wherein the body and fill cap, when joined, have rounded surfaces and no surface feature or surface transitions of ninety degrees or less.

12. The dispenser of claim 1, wherein the body second open end has a cross-section selected from one of the group of circular, oval, and oblong.

13. The dispenser of claim 1, wherein the body and fill cap are configured to receive therein two rolls of sheet material side by side when the fill cap is secured to the body.

14. The dispenser of claim 13, wherein the body has two side ports on opposing sides of the body, each side port being adjacent a respective roll contained within the body when two rolls are installed therein.

15. The dispenser of claim 14, wherein each side port has a respective access cap for selective engagement therewith.

16. The dispenser of claim 13, further comprising a wall disposed within the body interior for separating the two rolls received therein.

17. The dispenser of claim 13, further comprising a sealing wall selectively disposed between the fill cap and the body second open end, the sealing wall having projecting therefrom first and second spindles, and a plate disposed within the body first end, the plate having projecting therefrom third and fourth spindles, wherein when the sealing wall is disposed on the body second open end the first and third spindles are substantially coaxial and the second and fourth spindles are substantially coaxial.

18. The dispenser of claim 1, further comprising a sealing wall selectively disposed between the fill cap and the body second open end, the sealing wall having projecting therefrom a first spindle, and a plate disposed within the body first end, the plate having projecting therefrom a second spindle, wherein when the sealing wall is disposed on the body second open end the first and second spindles are substantially coaxial.

19. The dispenser of claim 1, wherein the roll is formed about a substantially cylindrical spool, the spool having a plurality of linear, parallel grooves formed thereon.

20. The dispenser of claim 19, wherein the grooves are formed as one of discontinuities in the spool outer surface and recesses in the spool outer surface.

21. The dispenser of claim 19, wherein the spool comprises an end wall at each end thereof, each end wall having an aperture for receiving a spindle therein and slots extending radially from the aperture.

* * * * *